US008468945B2

(12) United States Patent
Koide et al.

(10) Patent No.: US 8,468,945 B2
(45) Date of Patent: Jun. 25, 2013

(54) BLAST TREATMENT METHOD AND BLAST TREATMENT DEVICE

(75) Inventors: Kenji Koide, Kobe (JP); Ryusuke Kitamura, Kobe (JP); Nakaba Tsutsui, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 3 days.

(21) Appl. No.: 13/262,419

(22) PCT Filed: Mar. 24, 2010

(86) PCT No.: PCT/JP2010/002070

§ 371 (c)(1),
(2), (4) Date: Sep. 30, 2011

(87) PCT Pub. No.: WO2010/113430

PCT Pub. Date: Oct. 7, 2010

(65) Prior Publication Data

US 2012/0017752 A1 Jan. 26, 2012

(30) Foreign Application Priority Data

Mar. 31, 2009 (JP) ..... 2009-084663

(51) Int. Cl.
*F42B 33/06* (2006.01)
*F42D 5/04* (2006.01)

(52) U.S. Cl.
USPC ..... 102/293; 102/314; 86/50; 588/403; 89/36.17

(58) Field of Classification Search
USPC ..... 102/314, 332, 275.5, 275.6, 275.8, 102/275.11, 293; 86/50; 588/403; 89/1.13, 89/36.17
See application file for complete search history.

(56) References Cited

U.S. PATENT DOCUMENTS 6,647,851 B2 * 11/2003 Donovan ..... 86/50
7,398,720 B2 * 7/2008 Fujiwara et al. ..... 86/50
(Continued)

FOREIGN PATENT DOCUMENTS

JP 2005 516756 6/2005
JP 2005 291514 10/2005
(Continued)

OTHER PUBLICATIONS

English translation of the International Preliminary Report on Patentability issued Nov. 24, 2011, in PCT/JP2010/002070.
(Continued)

*Primary Examiner* — James Bergin
(74) *Attorney, Agent, or Firm* — Oblon, Spivak, McClelland, Maier & Neustadt, L.L.P.

(57) ABSTRACT

A blast treatment method enables easy and safe blast treatment of ammunition having propellant provided with a warhead having a bursting charge and a propulsion unit having a propellant. Comprised are a first explosive arrangement step of arranging a first explosive 70 on the outside of a warhead 11; a second explosive arrangement step of arranging a plurality of explosive members 80 including a second explosive 84 on the outside of the propulsion unit 12; a warhead blast step of causing detonation of a bursting charge 14 by detonation of a first explosive 70, thereby blasting the warhead 11; and a propulsion unit treatment step of causing deflagration of a propellant 18 by detonation of the second explosive 84, thereby performing combustion of the propulsion unit 12; the first explosive 70 is arranged at a position covering the periphery of the warhead 11, a high-pressure field is generated on the periphery of the warhead 11 by detonation of this first explosive 70, and by means of this high-pressure field, divergence of detonation energy of the bursting charge 14 to outside this high-pressure field is suppressed, and moreover the explosive members 80 are arranged at mutually separated positions whereby divergence of the combustion energy of the propellant 18 to the outside from the explosive members 80 is allowed, by which detonation of the propellant 18 is suppressed.

4 Claims, 5 Drawing Sheets

U.S. PATENT DOCUMENTS

| | | | | |
|---|---|---|---|---|
| 8,006,600 | B2 | 8/2011 | Fujiwara et al. | |
| 8,387,503 | B2 * | 3/2013 | Lesage et al. | 86/50 |
| 2009/0131733 | A1 | 5/2009 | Asahina et al. | |
| 2012/0017750 | A1 * | 1/2012 | Koide et al. | 86/50 |
| 2012/0017751 | A1 * | 1/2012 | Koide et al. | 86/50 |
| 2012/0017752 | A1 * | 1/2012 | Koide et al. | 86/50 |
| 2012/0017753 | A1 * | 1/2012 | Asahina et al. | 86/50 |
| 2012/0024133 | A1 * | 2/2012 | Fujiwara et al. | 86/50 |
| 2012/0031258 | A1 * | 2/2012 | Koide et al. | 86/50 |
| 2012/0137860 | A1 * | 6/2012 | Koide et al. | 86/50 |
| 2012/0192704 | A1 * | 8/2012 | Wilson et al. | 86/50 |

FOREIGN PATENT DOCUMENTS

| | | |
|---|---|---|
| JP | 2007 271136 | 10/2007 |
| JP | 2007 309550 | 11/2007 |
| JP | 2008 14595 | 1/2008 |

OTHER PUBLICATIONS

English translation of the Written Opinion of the International Searching Authority issued Jul. 13, 2010, in PCT/JP2010/002070.

International Search Report Issued Jul. 13, 2010 in PCT/JP10/002070 filed Mar. 24, 2010.

* cited by examiner

BLAST TREATMENT METHOD AND BLAST TREATMENT DEVICE

TECHNICAL FIELD

This invention relates to a blast treatment method and a blast treatment device for blasting ammunition and similar for military use having a propulsion unit.

BACKGROUND ART

Ammunition for military use (artillery shells, bombshells, land mines, underwater mines) comprise for example a steel or other shell within which are packed a bursting charge, and a chemical agent which is harmful to the human body, or similar. The bursting charge is detonated, and the chemical agent is scattered outward together with fragments of the shell. The ammunition is treated by blasting, for example. The treatment method by blasting requires no disassembling operation. This provides adaptability to a disposal not only of favorably preserved munitions, for example, but also of munitions hard to disassemble because of its deterioration over time, deformation, or the like. Further, when ammunitions including chemical agents hazardous to human bodies are treated by the treatment method, most of the chemical agents are decomposed under the ultra-high temperature and ultra-high pressure generated by explosion. An example of such a blast treatment method is disclosed in Patent Document 1.

According to the method disclosed in the Patent Document 1, a treatment subject is put in a container with an ANFO explosive around it, and the container is wrapped around by a sheet-shaped explosive having a greater detonation velocity than the ANFO explosive. When a predetermined end portion of the sheet-shaped explosive is initiated, the sheet-shaped explosive is progressively detonated in a given direction, and the detonation of the sheet-shaped explosive triggers the ANFO explosive to detonate progressively in a given direction. The detonation thereby caused breaks the shell of the object and detonates the bursting charge contained therein so that the object is blasted.

According to the method, the detonation vector of the ANFO explosive filled inside of the sheet-shaped explosive is directed inward by the detonation of the sheet-shaped explosive. When the detonation vector of the ANFO explosive is directed inward, the detonation vector of the bursting charge in the shell, which was originally directed outward, is directed inward. This slows down fragments of the shell scattering outward due to the explosion of the bursting charge.

Ammunition for military use includes ammunition with propellant having warheads which accommodate a bursting charge inside a shell and a propulsion unit to impart propulsion to the warhead (rockets, missiles, artillery shells having a propulsion unit, and similar). The propulsion unit has propellant to impart propulsion to the warhead. It is preferable that such ammunition having propellant be subjected to blasting as described above to render the ammunition harmless.

However, if the above-described blast treatment method is used to dispose of such ammunition with propellant, as a result of the detonation wave of the ANFO explosive covering the periphery of the propulsion unit, the propellant, which normally would only be deflagrated in a normal state of use, reaches detonation. And, there is the problem that an even higher pressure field than in the normal usage state occurs.

Patent Document 1: Japanese Patent Application Laid-open No. 2005-291514

SUMMARY OF THE INVENTION

Hence an object of this invention is to provide a blast treatment method which enables safe blast treatment of ammunition with propellant having a propulsion unit, employing a simple configuration.

In order to attain this object, a blast treatment method of this invention is a method of blasting ammunition having propellant provided with a warhead having a bursting charge and a propulsion unit provided on the rear end of the warhead and having a propellant that imparts propulsion to the warhead, the method comprising: a first explosive arrangement step of arranging a first explosive for blasting the warhead at a position on the outside of the warhead; a second explosive arrangement step of arranging a plurality of explosive members including a second explosive for initiating the propellant at positions on the outside of the propulsion unit; a warhead blast step of initiating detonation of the first explosive to cause detonation of the first explosive, and by means of the detonation of the first explosive, causing detonation of the bursting charge, thereby blasting the warhead; and a propulsion unit treatment step of initiating detonation of the second explosive to cause detonation of the second explosive, and causing deflagration of the propellant of the propulsion unit by means of detonation of the second explosive, thereby performing combustion of the propulsion unit, wherein in the first explosive arrangement step, the first explosive is arranged at a position covering the periphery of the warhead such that a high-pressure field is generated on the periphery of the warhead due to the detonation of the first explosive, and the high-pressure field suppresses divergence of detonation energy of the bursting charge to outside of this high-pressure field; and in the second explosive arrangement step, the plurality of explosive members are arranged in mutually separated positions, such that, by enabling divergence of the combustion energy of the propellant from the positions between the explosive members in the propulsion unit treatment step executed after the second explosive arrangement step, the detonation of the propellant is suppressed.

By means of this method, the high-pressure field generated on the periphery of the warhead by the first explosive suppresses the divergence of the detonation energy of the bursting charge to the outside, and suppresses scattering of shell fragments and similar to the outside. And, by arranging the explosive members in mutually separated positions so as to allow divergence to the outside of the combustion energy of the propellant, the propellant is deflagrated without being detonated, so that the occurrence of excessive shock is suppressed. By this means, safe blasting of the warhead and the propellant, are achieved.

EMBODIMENTS FOR CARRYING OUT THE INVENTION

Figure 1:
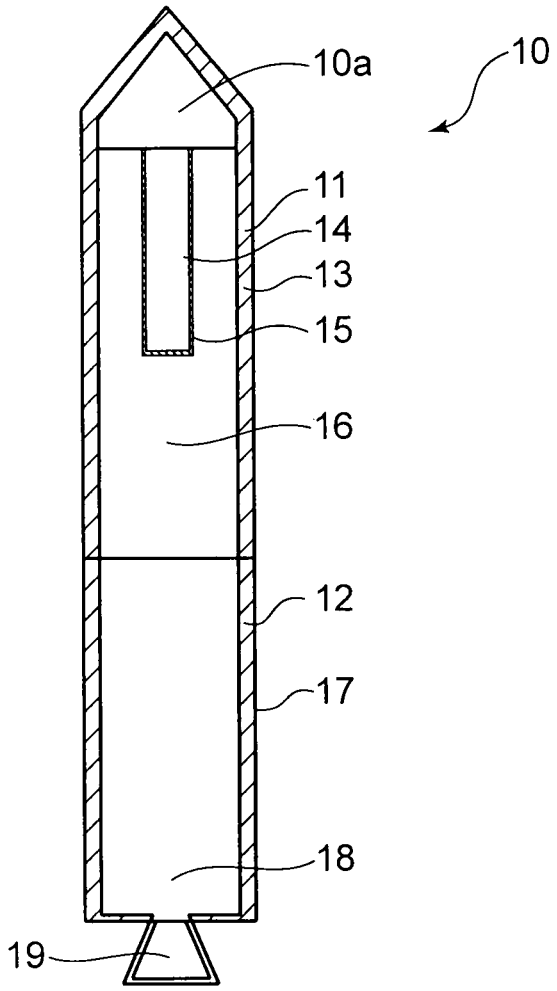
FIG. 1 is a cross-sectional view showing ammunition with propellant which is to be blasted by a blast treatment method of this invention.
Figure 2:
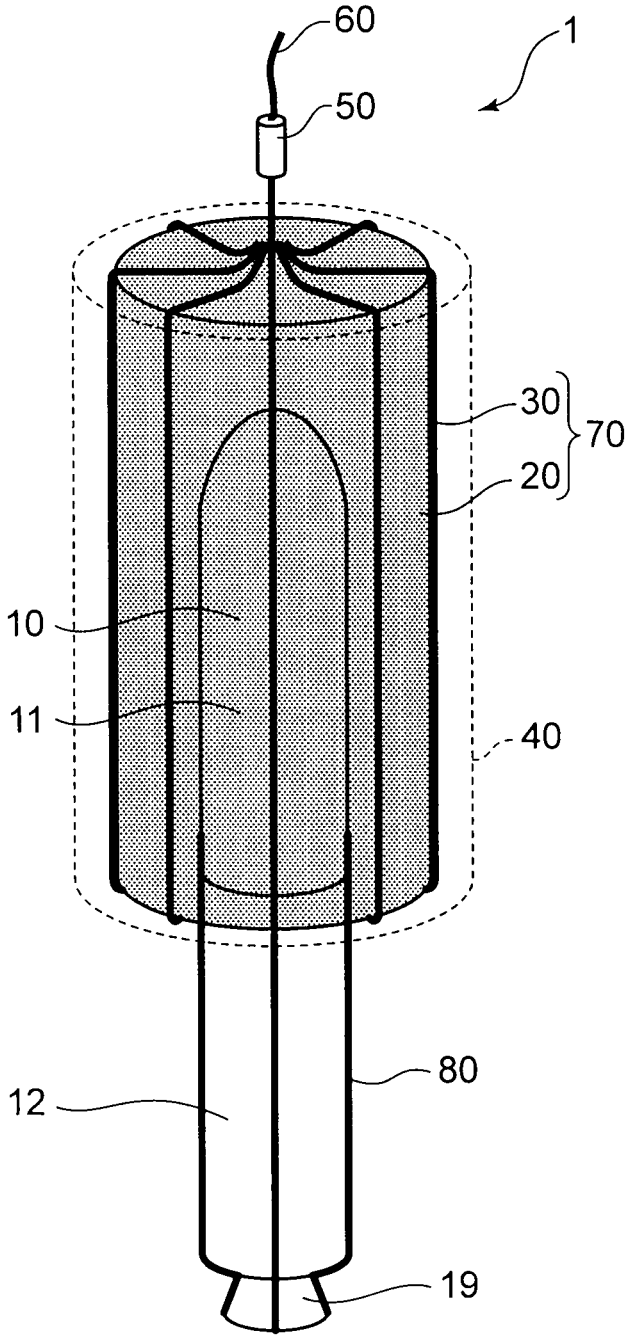
FIG. 2 is a schematic perspective view showing the state of mounting of the ammunition with propellant shown in FIG. 1 in a blast treatment device of this invention.
Figure 3:
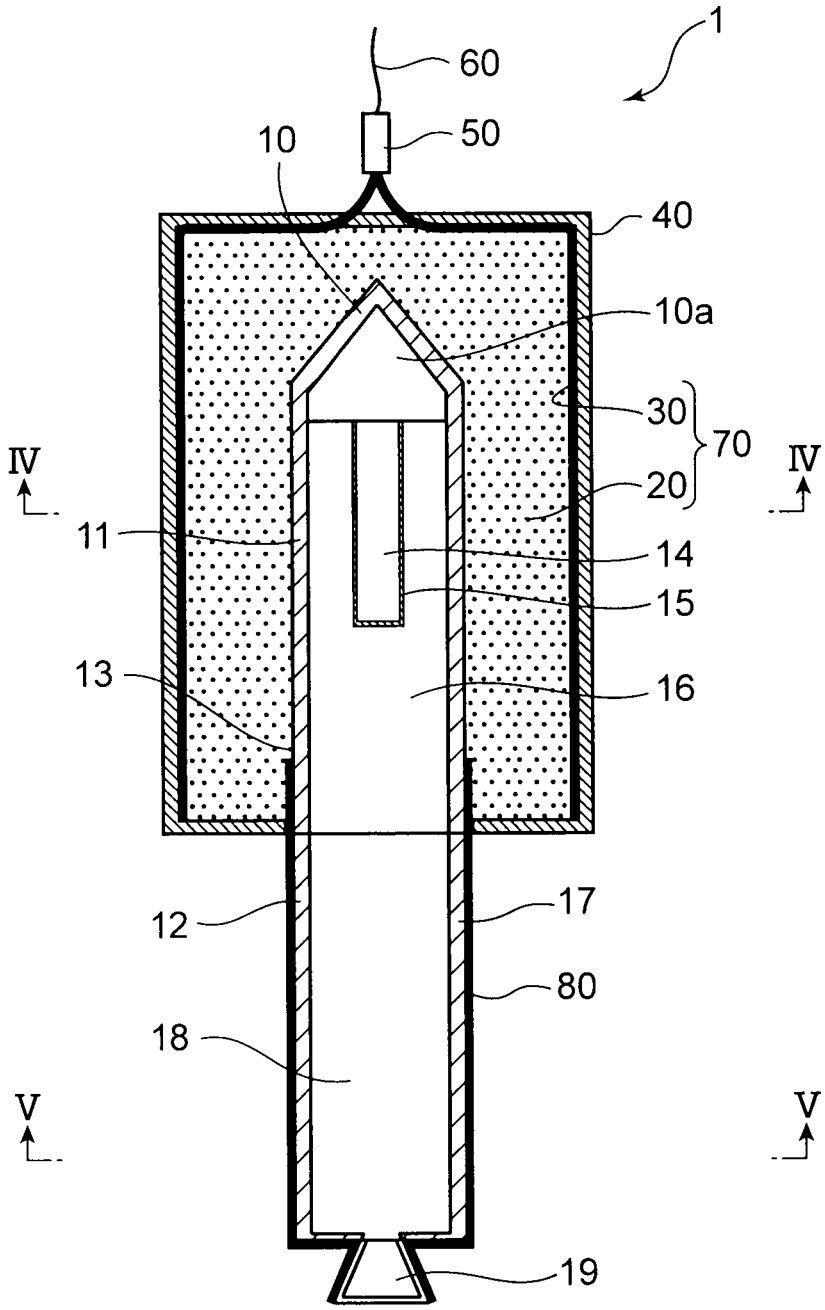
FIG. 3 is a vertical cross-sectional view of FIG. 2.
Figure 4:
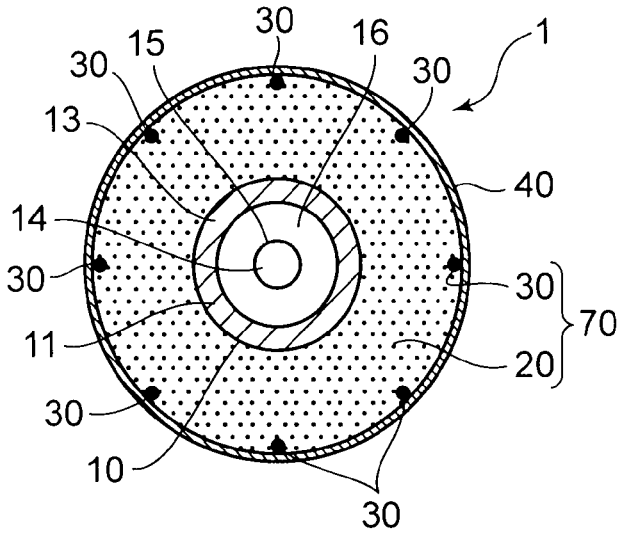
FIG. 4 is a cross-sectional view along line IV_IV in FIG. 3.
Figure 5:
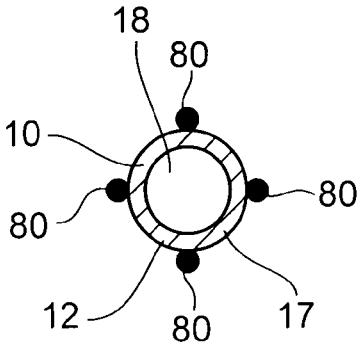
FIG. 5 is a cross-sectional view along line V-V in FIG. 3.

Below, an embodiment of a blast treatment method of this invention is explained, referring to the drawings. FIG. 1 is a schematic cross-sectional view of a rocket, which is an example of ammunition with propellant which is to be blasted by this blast treatment method. FIG. 2 is a schematic perspective view of a state in which the rocket is installed in a blast treatment device used in this blast treatment method. FIG. 3 is a vertical cross-sectional view of FIG. 2. FIG. 4 is a cross-sectional view along line IV-IV in FIG. 3, and FIG. 5 is a cross-sectional view along line V-V in FIG. 3.

The rocket 10, which is an example of an treatment subject, has a shape extending in an axial direction, as shown in FIG. 1. This rocket 10 has a warhead 11, and a rocket motor (propulsion unit) 12 connected to the rear end of the warhead 11.

The warhead 11 has within a shell 13 a fuze 10*a*, and a burster tube 15. Within the burster tube 15 is accommodated a bursting charge 14, comprising picric acid, TNT, or similar. Between the shell 13 and the burster tube 15 is accommodated a chemical agent 16, which is a toxic material. The rocket motor 12 is provided to impart propulsion to the warhead 11. This rocket motor 12 has a case 17 and a propellant 18 accommodated within the case 17. This propellant 18 comprises, for example, smokeless gunpowder. This propellant 18 imparts propulsion to the warhead 11 by combustion of the smokeless gunpowder, and by emitting a jet of a compressed gas from the nozzle 19.

This rocket 10 obtains propulsion from combustion of the propellant 18, and begins flight toward a prescribed object. When the fuze 10*a* provided in the warhead 11 operates under prescribed conditions, the bursting charge 14 is detonated. The divergence outward of the detonation energy of this bursting charge 14 is accompanied by scattering of fragments of the shell 13 and the chemical agent 16 to the periphery.

This blast treatment method is a method to perform blasting of and render harmless the bursting charge 14 and chemical agent 16 included in the rocket 10 as described above. In this blast treatment method, as shown in FIG. 2, a blast treatment device 1 having a first explosive 70, explosive members 80, container 40, and electric detonator (initiation device) 50, is used, to perform blasting within a blasting chamber, not shown.

Here, the first explosive 70 is an explosive to blast the warhead 11. This first explosive 70 has an inside explosive 20 and a cord-like explosive member 30. The inside explosive 20 is an explosive used to detonate and blast the warhead 11. The cord-like explosive member 30 includes an outside explosive 34 to initiate this inside explosive 20. Further, the explosive members 80 include a second explosive 84. The second explosive 84 is an explosive to detonate and ignite the propellant 18 within the rocket motor 12. The container 40 accommodates the warhead 11 of the rocket 10 and the first explosive 70. The electric detonator 50 is used to initiate the first explosive 70.

The blast treatment method includes the following steps.

1) Second Explosive Arrangement Step

This step is a step of arranging the explosive members 80 at positions on the outside of the rocket motor 12, in a state of mutual separation from each other, in order that detonation of the second explosive 84 contained in the explosive members 80 can ignite the propellant 18, and at the same time the combustion energy of the propellant 18 can diverge to the outside.

In order for the second explosive 84 contained in the explosive members 80 to cause combustion of all of the propellant 18, a greater number of explosive members 80 may be arranged on the periphery of the rocket motor 12. However, if the quantity of explosive members 80 arranged on the periphery of the rocket motor 12 increases, the detonation wave of the second explosive 84 contained in the explosive members 80 covers the periphery of the rocket motor 12. As a result, there is the concern that a high-pressure field equal to or exceeding a prescribed value may occur on the periphery of the rocket motor 12. If the periphery of the rocket motor 12 is covered by a high-pressure field in this way, the combustion energy of the ignited propellant 18 cannot diverge to the outside, and there is a strong possibility that detonation of the propellant 18 will occur. If the propellant 18 detonates, an excessive shock occurs. This shock may damage the blast chamber. That is, early replacement of the blast chamber may become necessary. Hence in order to safely and efficiently perform blasting, the propellant 18 must be deflagrated without the occurrence of detonation. In order to avoid detonation of the propellant 18, overlapping of detonation waves of the second explosive 84 must be suppressed, and the occurrence of an ultra-high pressure field at or above a prescribed value on the periphery of the propellant 18 must be avoided. That is, the explosive members 80 including the second explosive 84 must be arranged in a state of adequate mutual separation.

The value of the peripheral pressure when the propellant 18 reaches detonation differs depending on the type and quantity of the propellant 18, on the size of the rocket motor 12, and on other factors. The quantity of explosive members 80 to blast all the propellant 18 differs depending on the size of the rocket motor 12 and similar. Hence the quantity and method of arrangement of the explosive members 80 may be set appropriately according to the type of the rocket for blasting and the type of the second explosive 84.

Figure 6:
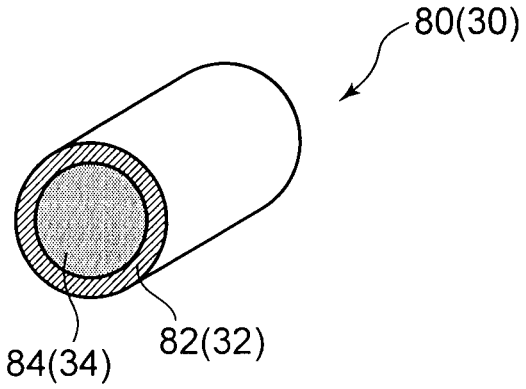
FIG. 6 is a cross-sectional view of an explosive member and cord-like explosive member used in the blast treatment device shown in FIG. 2.

In this embodiment, as the explosive members 80, members having a shape extending in one direction and having the second explosive 84 on the inside are used. More specifically, as the explosive members 80, string-like detonating cords the powder core of which is the second explosive (PETN), with the powder core covered, are used. These explosive members 80 have outer tubes 82, and a second explosive 84 comprising PETN accommodated within the outer tubes 82, as shown in FIG. 6. The outer tubes 82 are of plastic or similar, extending in one direction.

First, the above-described long string-like detonating cord, prepared in advance, is cut according to the size and shape of the rocket motor 12, to form four explosive members 80. Next, these four explosive members 80 are arranged on the outside face of the rocket motor 12. At this time, each of the explosive members 80 is arranged parallel to the central axis of the rocket motor 12, extending in the front-to-rear direction. Further, the explosive members 80 are separated at equal intervals in the circumferential direction of the rocket motor 12, leaving open a sufficient distance that overlapping of detonation waves of the second explosive 84 is suppressed.

By means of this arrangement, in the subsequent blast step, the detonation of the second explosive 84 uniformly ignites the propellant 18 at the outer peripheral face of the propellant 18. Further, detonation of the second explosive 84 propagates parallel to the central axis of the rocket motor 12, and the propellant 18 is ignited along this central axis, to ignite all of the propellant 18.

In this step, the explosive members 80 are arranged such that the front-end portions are inserted into the container 40.

2) First Explosive Arrangement Step

This step is a step in which the first explosive 70 is arranged at a position outside the warhead 11. As explained above, this first explosive 70 comprises an inside explosive 20 and a cord-like explosive member 30. In this step, after arranging the cord-like explosive member 30 on the outside of the warhead 11, the inside explosive 20 is arranged between the cord-like explosive member 30 and the warhead 11.

In this embodiment, as the cord-like explosive member 30, an explosive member with the same configuration as the explosive members 80 is used. The cord-like explosive member 30 has an outer tube 32, and an outside explosive 34 with the same component (powder core PETN) as the second explosive 84, accommodated inside this outer tube 32.

By cutting the string-like detonating cord, a cord-like explosive member 30 is formed. Specifically, the detonating cord is cut according to the size and shape of the warhead 11, to form eight cord-like explosive members 30 having the same length.

The eight cord-like explosive members 30 are arranged at positions surrounding the outside of the warhead 11 within the container 40. The cord-like explosive members 30 are arranged parallel to the central axis of the warhead 11, and at equal intervals in the circumferential direction.

Then, the rocket 10 is inserted so as to be coaxial with the container 40 into the container 40 in which are arranged the cord-like explosive members 30.

Next, the inside explosive 20 is poured between the warhead 11 and the inside face of the container 40. By this means, the inside explosive 20 is disposed on the periphery of the warhead 11. The inside explosive 20 is disposed such that the rear-end portion thereof is in contact with the front-end portions of the explosive members 80 arranged on the periphery of the rocket motor 12.

As explained above, the inside explosive 20 is an explosive which is detonated to blast the warhead 11. This inside explosive 20 may be any kind of explosive, so long as the detonation velocity is slower than that of the outside explosive 34. However, as the inside explosive 20, an explosive having fluidity such as a powder or fluid, for example an emulsion explosive, slurry explosive, or ANFO explosive, may be used. The detonation velocity of an emulsion explosive or slurry explosive is approximately 5 km/s, and the detonation velocity of an ANFO explosive is approximately 3 km/s. The detonation velocity of the PETN comprised by the above-described outside explosive 34 is approximately 6 to 7 km/s. Hence the detonation velocity of the outside explosive 34 is sufficiently high compared with the detonation velocity of the inside explosive 20.

3) Blast Step

In this step, while detonating the bursting charge 14 by means of detonation of the first explosive 70, the warhead 11 is blasted (warhead blast step), and in addition the propellant 18 is deflagrated by the detonation of the second explosive 84, while performing combustion of the rocket motor 12 (propulsion unit treatment step).

In this step, first, the cord-like explosive members 30 are connected to a common electric detonator 50. Specifically, the front-end portions of the eight cord-like explosive members 30 are gathered at the central axis of the container 40, and the electric detonator 50 is brought into contact with the bundle of these cord-like explosive members 30. The distances from the points of contact of the cord-like explosive members 30 and the electric detonator 50, that is, the initiation point of the outside explosive 34, to the outer peripheral face of the inside explosive 20, are made equal.

Next, the electric detonator 50 is connected to a firing device, not shown, via a firing cable 60.

Then, the firing device is operated. By this means, the electric detonator 50 simultaneously initiates all of the outside explosive 34 contained in each of the cord-like explosive members 30.

The outside explosive 34, which has been initiated, begins detonation. Detonation of the outside explosive 34 propagates radially outward. Then, while initiating the inside explosive 20, propagation of detonation of the outside explosive 34 continues through the outer peripheral face of the inside explosive 20 along the axis direction of the container 40. The initiated inside explosive 20 begins detonation. This inside explosive 20, while initiating the bursting charge 14 of the warhead 11, generates an ultra-high temperature and high-pressure field on the periphery of the warhead 11. The initiated bursting charge 14 begins detonation. Detonation of the inside explosive 20 and bursting charge 14 destroys the shell 13. At this time, fragments of the destroyed shell 13 scatter outward. However, there exists a high-pressure field, generated by the inside explosive 20, on the periphery of the shell 13. Consequently, fragments of the shell 13 are impeded by this high-pressure field, and scattering outward is suppressed. And, the chemical agent 16 within the warhead 11 is exposed to the ultra-high temperature and high-pressure field generated by detonation of the inside explosive 20 and the bursting charge 14, and so is decomposed and rendered harmless. In this way, the warhead 11 is destroyed through detonation of the inside explosive 20.

On the other hand, the detonation wave of the inside explosive 20 which has propagated along the axis direction propagates to the explosive members 80 at the front-end portion of the rocket motor 12, and initiates the second explosive 84 contained in the explosive members 80.

The initiated second explosive 84 begins detonation. Detonation of the second explosive 84 ignites the propellant 18, while propagating toward the rear end. The ignited propellant 18 begins deflagration while generating combustion energy.

As stated above, the second explosive 84 is arranged in a state of mutual separation such that combustion energy of the propellant 18 can diverge outward. Hence the second explosive 84 does not form a high-pressure field on the periphery of the propellant 18 sufficient to confine the combustion energy of the propellant 18. Hence the propellant 18 undergoes deflagration without reaching detonation. The rocket motor 12 is subjected to combustion treating through deflagration of the propellant 18.

As described above, by using this blast treatment method, the inside explosive 20 detonates to generate a high-pressure field on the periphery of the warhead 11, and this high-pressure field suppresses divergence of the detonation energy of the bursting charge 14 to the outside, so that the scattering of fragments of the shell 13 and the chemical agent 16 to the outside is suppressed, while safely blasting the warhead 11. Further, the explosive members 80 are arranged at mutually separated positions so as to allow divergence of the combustion energy of the propellant 18 to the outside, and this propellant 18 is deflagrated without reaching detonation. By avoiding detonation of the propellant 18, the excessive shock accompanying this detonation is suppressed, and the rocket motor 12 is safely blasted. Further, by means of this method, it is sufficient to arrange the explosive members 80 in a mutually separated state at the rocket motor 12. Hence compared with cases in which the entire periphery of the propulsion unit 12 is covered with explosive, as in the prior art, the quantity of explosive arranged on the periphery of the propulsion unit 12 can be kept smaller. This decreases costs.

Further, the first explosive 70 comprises the inside explosive 20 and the cord-like explosive members 30; the inside explosive 20 is arranged on the periphery of the warhead 11, and the cord-like explosive members 30 are arranged on the outside of the inside explosive 20. And, detonation of the outside explosive 34 contained in the cord-like explosive members 30 initiates detonation of the inside explosive 20, and the detonation vector of the inside explosive 20 is inward-directed. This effectively suppresses divergence of the detonation energy of the bursting charge 14 to outside. Further, the detonation wave of the inside explosive 20 effectively collides with the warhead 11, so that the warhead 11 is more reliably blasted.

Further, the front-end portions of the explosive members 80 are in contact with the inside explosive 20, and detonation of the inside explosive 20 is transmitted from the front-end portions toward the rear to initiate the second explosive 84 of the explosive members 80. Hence there is no need to separately initiate the second explosive 84, and the efficiency of blast treatment is enhanced. Further, after detonation of the inside explosive 20, combustion of the propellant 18 begins. Hence the influence on the warhead 11 of the propulsion occurring due to deflagration of this propellant 18 is small. That is, a situation in which the warhead 11 is propelled and collides with the blast chamber is avoided. This makes the blast treatment safe.

Further, as the explosive members 80, members which include the second explosive 84 and which extend in one direction are used, and the second explosive 84 is easily arranged on the periphery of the rocket motor 12.

Here, the shape and arrangement method of the explosive members 80 are not limited to those described above. The explosive members 80 need only be able to ignite the propellant 18 while avoiding detonation, and an explosive different from the cord-like explosive members 30 may be used. For example, a plurality of explosive members 80 formed into a sheet shape may be used; the plurality of sheet-shape explosive members 80 may be arranged at prescribed intervals in positions on the outside of the rocket motor 12. Further, the explosive members 80 and the cord-like explosive members 30 may be comprised by a single detonating cord or similar. That is, a plurality of detonating cords may be arranged across the warhead 11 and the rocket motor 12.

Further, the cord-like explosive members 30 need only have an detonation velocity greater than the detonation velocity of the inside explosive 20, and are not limited to those described above. For example, as cord-like explosive members 30, sheet-shape members may be used, and may be made to cover the entire perimeter of the inside explosive 20. The type of the inside explosive 20 is not limited to that described above. However, an emulsion explosive is comparatively inexpensive. Hence if an emulsion explosive is used, the overall costs of the blast treatment are reduced.

Further, the order of the steps is not limited to that described above. For example, after accommodating the rocket 10 in the container 40, the first explosive arrangement step and second explosive arrangement step may be performed. Further, the warhead blasting step and propulsion unit treatment step may be begun simultaneously. In this case, the explosive members 80 arranged at the rocket motor 12 may be directly connected with an initiation device, and the explosive members 80 may be initiated separately from the cord-like explosive members 30.

Further, the container 40 may be omitted. In this case, for example the inside explosive 20 may be packed into a bag, and this bag may be fixed in place on the periphery of the warhead 11.

Further, in the above blast treatment method, the ammunition with propellant for blast treatment is not limited to a rocket 10 with a chemical agent as described above. By means of this blast treatment method, rockets without chemical agents, and missiles may be subjected to blasting. Further, by means of this blast treatment method, ammunition in which the warhead and the propulsion unit are formed as separate members, such as for example an artillery shell fastened to a cartridge including a propellant to fire the artillery shell, may be blasted. Further, by means of this blast treatment method, a rocket 10 which is accommodated in a protective case may be blasted.

As described above, this invention provides a blast treatment method of blasting ammunition having propellant provided with a warhead having a bursting charge and a propulsion unit provided on the rear end of the warhead and having a propellant that imparts propulsion to the warhead, the method comprising: a first explosive arrangement step of arranging a first explosive for blasting the warhead at a position on the outside of the warhead; a second explosive arrangement step of arranging a plurality of explosive members including a second explosive for initiating the propellant at positions on the outside of the propulsion unit; a warhead blast step of initiating detonation of the first explosive to cause detonation of the first explosive, and by means of the detonation of the first explosive, causing detonation of the bursting charge, thereby blasting the warhead; and a propulsion unit treatment step of initiating detonation of the second explosive to cause detonation of the second explosive, and causing deflagration of the propellant of the propulsion unit by means of detonation of the second explosive, thereby performing combustion of the propulsion unit, wherein in the first explosive arrangement step, the first explosive is arranged at a position covering the periphery of the warhead such that a high-pressure field is generated on the periphery of the warhead due to the detonation of the first explosive, and the high-pressure field suppresses divergence of detonation energy of the bursting charge to outside of this high-pressure field; and in the second explosive arrangement step, the plurality of explosive members are arranged in mutually separated positions, such that, by enabling divergence of the combustion energy of the propellant from the positions between the explosive members in the propulsion unit treatment step executed after the second explosive arrangement step, the detonation of the propellant is suppressed.

By means of this method, detonation of the first explosive generates a high-pressure field on the periphery of the warhead, and this high-pressure field suppresses the divergence of the detonation energy of the bursting charge to the outside. Consequently, scattering of fragments of the shell of the warhead and similar to the outside is suppressed. In particular, when a chemical agent is included within the warhead, the chemical agent is decomposed due to the detonation energy. And, by arranging the explosive members at mutually separated positions so as to allow divergence to the outside of the combustion energy of the propellant, the propellant is deflagrated without reaching detonation, and the occurrence of excessive shocks accompanying propellant detonation is suppressed.

In this way, by means of this invention, detonation of the propellant is avoided while safely blasting the warhead, and the propulsion unit is safely blasted. Further, compared with cases in which the periphery of the propulsion unit is covered with explosive as in the prior art, the quantity of explosive arranged on the periphery of the propulsion unit is decreased, which is also advantageous from the standpoint of costs.

Further, in this invention it is preferable that the first explosive have an inside explosive for blasting the warhead and an outside explosive with detonation velocity higher than that of the inside explosive; the first explosive arrangement step include a step of arranging the inside explosive at a position covering the periphery of the warhead, and a step of arranging the outside explosive in a position outside the inside explosive; and the warhead blast step include a step of initiating detonation of the outside explosive, and through this detonation of the outside explosive, initiating detonation of the inside explosive, thereby directing a detonation wave of this inside explosive inward, and by means of the inward-directed detonation wave, suppressing the divergence, to the outside, of the detonation energy of the bursting charge, whereby the warhead is blasted.

By means of this method, the inward-directed detonation wave of the outside explosive propagates to the inside explosive, and the detonation vector of the inside explosive is directed inward. And, by imparting this inward-directed detonation vector of the inside explosive to the bursting charge, divergence to the outside of the detonation energy of the bursting charge is effectively suppressed. This achieves more reliable blasting of the warhead.

Further, in this invention, it is preferable that the second explosive arrangement step include a step of arranging the plurality of explosive members at positions where front-end portions of the explosive members are in contact with the first explosive, the warhead blast step include a step of initiating detonation of the front-end portion of the first explosive and inducing propagation of the detonation of the first explosive toward the rear, and the propulsion unit treatment step include a step of initiating detonation of the second explosive contained in each of the explosive members by means of the detonation of the first explosive.

In this way, if detonation of the front-end portions of the first explosive is initiated and the detonation of the first explosive propagates toward the rear, and detonation of the second explosive is initiated by the detonation of the first explosive, then there is no need for separate initiation of detonation of the second explosive, and blast treatment is performed efficiently. Further, by means of propagation of the detonation of the first explosive, detonation of the second explosive is initiated, and after initiation of detonation of the bursting charge by the detonation of the first explosive, the propellant is ignited by the second explosive, so that the influence on the warhead of the propulsion generated by deflagration of the propellant is reduced. By this means, safer blast treatment is achieved.

Further, it is preferable that each of the explosive members have a shape extending in one direction, and that in the second explosive arrangement step, a step be performed in which the plurality of explosive members are arranged so as to extend in the front-rear direction, in a state of mutual separation in a circumferential direction of the propulsion unit.

By this means, merely by arranging explosive members having a shape extending in one direction on the outside of the propulsion unit, the second explosive can be arranged on the outside of the propulsion unit by simple means. This enhances the efficiency of blast treatment. Further, each of the explosive members is arranged so as to extend in the front-rear direction, and detonation of the second explosive of each of the explosive members propagates efficiently from the front-end portion to the rear. Accompanying this, the propellant is efficiently deflagrated in the front-rear direction.

Further, this invention provides a blast treatment device, comprising: a first explosive which is provided at a position covering a periphery of the warhead, detonation of which generates a high-pressure field on the periphery of the warhead, and which, by means of the high-pressure field, the bursting charge of the warhead is caused to detonate, whereby the warhead is blasted; a plurality of explosive members which include a second explosive, and which are provided at positions on the outside of the propulsion unit, to perform combustion of the propulsion unit, while deflagrating the propellant of the propulsion unit; and an initiation device which initiates detonation of the first explosive, wherein the front-end portions of each of the plurality of explosive members are in contact with the first explosive, and moreover the plurality of explosive members are provided, in a state of mutual separation, at positions which allow the divergence of combustion energy of the propellant to the outside.

By means of this device, by using the initiation device to initiate detonation of the first explosive and generate a high-pressure field on the periphery of the warhead accompanying detonation of the first explosive, propagation of the detonation wave of the bursting charge of the warhead to the outside is suppressed, and moreover the warhead is blasted. And, by igniting the propellant by means of the detonation of the second explosive, the propulsion unit is treated while deflagrating the propellant. In particular, explosive members including the second explosive are provided in a state of mutual separation, and the combustion energy of the propellant can diverge to the outside. Hence detonation of the propellant can be more reliably avoided. Further, by means of this device the explosive members are arranged so as to be in contact with the first explosive, and by detonation of the first explosive, the second explosive included in the explosive members is initiated, so that blast treatment is performed efficiently.

The invention claimed is:

1. A blast treatment method of blasting ammunition having propellant provided with a warhead having a bursting charge and a propulsion unit provided on the rear end of the warhead and having a propellant that imparts propulsion to the warhead, the method comprising:

a first explosive arrangement step of arranging a first explosive for blasting the warhead at a position on the outside of the warhead;

a second explosive arrangement step of arranging a plurality of explosive members including a second explosive for initiating the propellant at positions on the outside of the propulsion unit;

a warhead blast step of initiating detonation of the first explosive to cause detonation of the first explosive, and by means of the detonation of the first explosive, causing detonation of the bursting charge, thereby blasting the warhead; and a propulsion unit treatment step of initiating detonation of the second explosive to cause detonation of the second explosive, and causing deflagration of the propellant of the propulsion unit by means of detonation of the second explosive, thereby performing combustion of the propulsion unit, wherein in the first explosive arrangement step, the first explosive is arranged at a position covering the periphery of the warhead such that a high-pressure field is generated on the periphery of the warhead due to the detonation of the first explosive, and the high-pressure field suppresses divergence of detonation energy of the bursting charge to outside of this high-pressure field; and in the second explosive arrangement step, the plurality of explosive members are arranged in mutually separated positions, such that, by enabling divergence of the combustion energy of the propellant from the positions between the explosive members in the propulsion unit treatment step executed after the second explosive arrangement step, the detonation of the propellant is suppressed.

2. The blast treatment method according to claim 1, wherein the first explosive has an inside explosive for blasting the warhead and an outside explosive with detonation velocity higher than that of the inside explosive;

the first explosive arrangement step includes a step of arranging the inside explosive at a position covering the periphery of the warhead, and a step of arranging the outside explosive in a position outside the inside explosive; and the warhead blast step includes a step of initiating detonation of the outside explosive, and through this detonation of the outside explosive, initiating detonation of the inside explosive, thereby directing a detonation wave of this inside explosive inward, and by means of the inward-directed detonation wave, suppressing the divergence, to the outside, of the detonation energy of the bursting charge, whereby the warhead is blasted.

3. The blast treatment method according to claim 1, wherein the second explosive arrangement step includes a step of arranging the plurality of explosive members at positions where front-end portions of the explosive members are in contact with the first explosive, the warhead blast step includes a step of initiating detonation of the front-end portion of the first explosive and inducing propagation of the detonation of the first explosive toward the rear, and the propulsion unit treatment step includes a step of initiating detonation of the second explosive contained in each of the explosive members by means of the detonation of the first explosive.

4. The blast treatment method according to claim 3, wherein each of the explosive members has a shape extending in one direction, and the second explosive arrangement step includes a step in which the plurality of explosive members are arranged so as to extend in the front-rear direction, in a state of mutual separation in a circumferential direction of the propulsion unit.

* * * * *